US007134844B2

(12) United States Patent
Robin

(10) Patent No.: US 7,134,844 B2
(45) Date of Patent: Nov. 14, 2006

(54) INSTALL BLADE BRACKET FOR A CEILING SUSPENDED FAN

(76) Inventor: Fan Robin, 1F., No. 28, Lane 197, Songyi St., Beitun District, Taichung City 406 (TW)

( * ) Notice: Subject to any disclaimer, the term of this patent is extended or adjusted under 35 U.S.C. 154(b) by 121 days.

(21) Appl. No.: 11/053,037

(22) Filed: Feb. 8, 2005

(65) Prior Publication Data

US 2006/0177313 A1 Aug. 10, 2006

(51) Int. Cl.
*F04D 29/34* (2006.01)

(52) U.S. Cl. ..... 416/210 R; 416/206; 416/219 R; 416/220 R

(58) Field of Classification Search ..... 416/5, 416/204 R, 206, 207, 210 R, 219 R, 220 R, 416/220 A, 221
See application file for complete search history.

(56) References Cited

U.S. PATENT DOCUMENTS 6,048,173 A * 4/2000 Chen ..... 416/210 R
6,059,531 A * 5/2000 Tai ..... 416/220 A
6,139,276 A * 10/2000 Blateri et al. ..... 416/210 R
6,149,388 A * 11/2000 Liao ..... 416/210 R
6,261,064 B1 * 7/2001 Tang ..... 416/210 R
6,347,924 B1 * 2/2002 Chang ..... 416/210 R
6,378,824 B1 * 4/2002 Tseng ..... 248/220.21
6,676,376 B1 * 1/2004 Kerr, Jr. ..... 416/142
6,699,014 B1 * 3/2004 Lam et al. ..... 416/5
6,916,156 B1 * 7/2005 Tseng ..... 416/206
7,008,192 B1 * 3/2006 Hidalgo ..... 416/206

* cited by examiner

*Primary Examiner*—Igor Kershteyn
(74) *Attorney, Agent, or Firm*—Charles E. Baxley

(57) ABSTRACT

A install blade bracket for a ceiling suspended fan comprises: a discal seat is disposed at a bottom of the rotary assembly, the discal seat is formed with a recess, in the recess are defined a plurality of locking cavities and a plurality of receiving cavities, a plurality of positioning structures disposed in the respective receiving cavities; a plurality of fan blade mounting brackets each of which is provided with a locking portion and a plurality of projections correspondingly to the locking cavities and the positioning structures, each of the projections has a curved limit surface and a guiding slope arranged.

9 Claims, 7 Drawing Sheets

INSTALL BLADE BRACKET FOR A CEILING SUSPENDED FAN

BACKGROUND OF THE INVENTION

1. Field of the Invention

The present invention relates to a blade bracket for a ceiling suspended fan, and more particularly to an easy install blade bracket for a ceiling suspended fan.

2. Description of the Prior Arts

Fan blade mounting bracket is one of the important structure in a ceiling suspended fan, as shown in FIG. 1, a conventional fan blade mounting bracket 11 is locked to the bottom of the rotary assembly 10 of a ceiling suspended fan, this conventional locking structure has been used on the ceiling suspended fan for many years, however, it still has some disadvantages that could be improved.

Due to the fan blade mounting bracket 11 is locked with the rotary assembly 10, and normally the number of the fan blade mounting brackets 11 locked on the rotary assembly 10 is no less than three, it is really time-consuming for the worker to assemble all the fan blade mounting brackets 11 to the rotary assembly 10.

The present invention has arisen to mitigate and/or obviate the afore-described disadvantages.

SUMMARY OF THE INVENTION

The primary objective of the present invention is to provide a install blade bracket for a ceiling suspended fan which is capable of creating a quick engagement between the fan blade mounting brackets and the discal seat.

A install blade bracket for a ceiling suspended fan provided in accordance with the present invention, comprising:

a rotary assembly of a ceiling suspended fan;

a discal seat disposed at a bottom of the rotary assembly, at a bottom of the discal seat formed a recess, on sidewall of the recess defined a plurality of locking cavities, at outer margin of the recess provided a plurality of receiving cavities correspondingly to the respectively locking cavities;

a plurality of positioning structures being elastically and moveably disposed in the respective receiving cavities of the discal seat;

a plurality of fan blade mounting brackets, at an end of each of the fan blade mounting brackets formed a locking portion for being positioned in the locking cavities of the discal seat, a plurality of projections disposed on the respective fan blade mounting brackets correspondingly to the positioning structures, each of the projections having a curved limit surface and a guiding slope arranged in the direction of the rotary assembly, after the guiding slope push the positioning structures, the positioning structures will be positioned on the curved limit surface of the respective projections.

The present invention will become more obvious from the following description when taken in connection with the accompanying drawings, which show, for purpose of illustrations only, the preferred embodiments in accordance with the present invention.

DETAILED DESCRIPTION OF THE PREFERRED EMBODIMENTS

Figure 1:
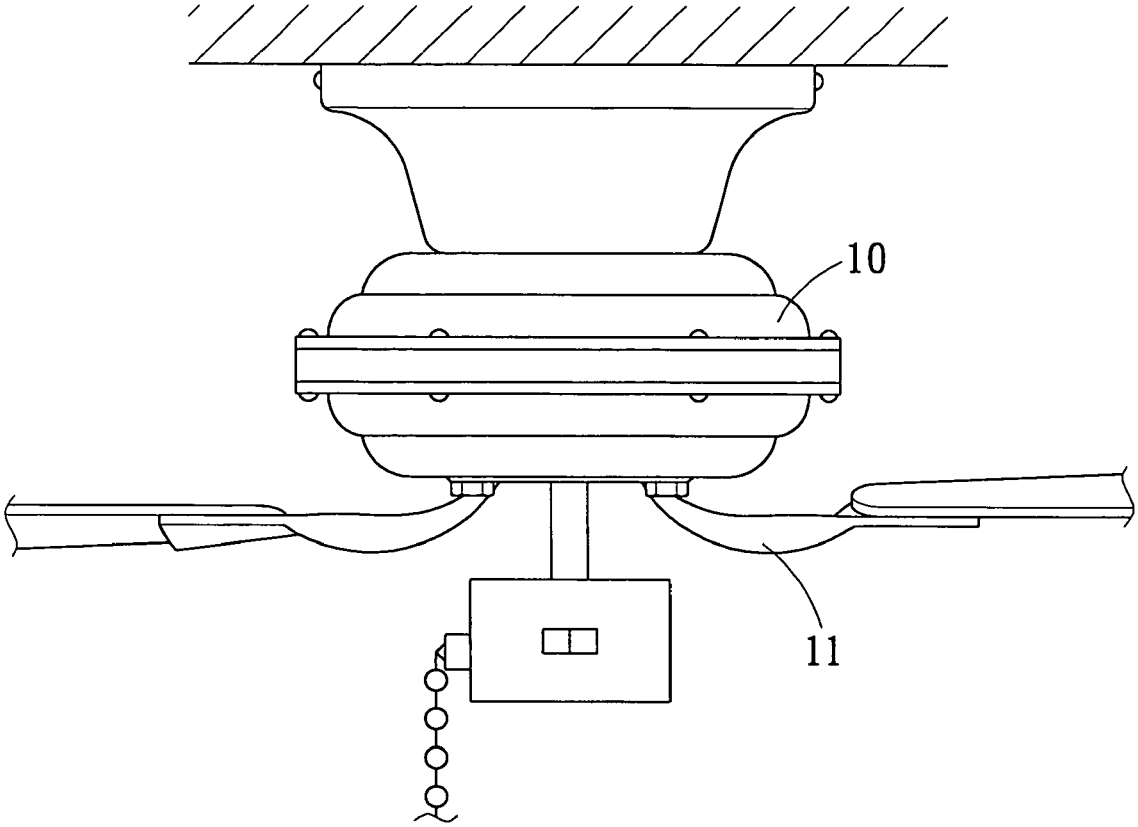
FIG. 1 PRIOR ART
FIG. 1 is an assembly view of a conventional blade bracket locked on the rotary assembly of a ceiling suspended fan.
Figure 2:
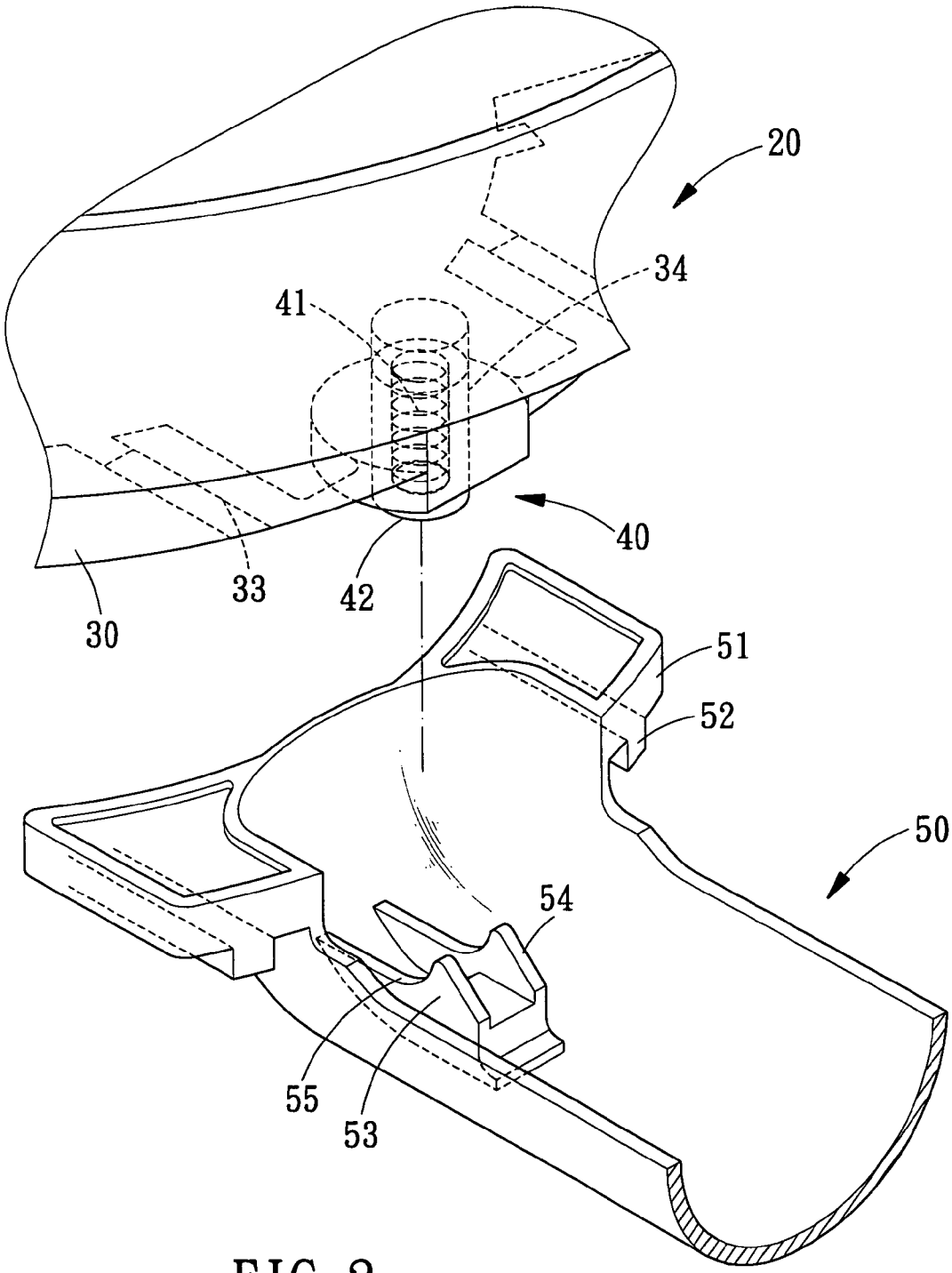
FIG. 2 is an exploded view of part of a blade bracket for a ceiling suspended fan in accordance with a first preferred embodiment of the present invention.
Figure 3:
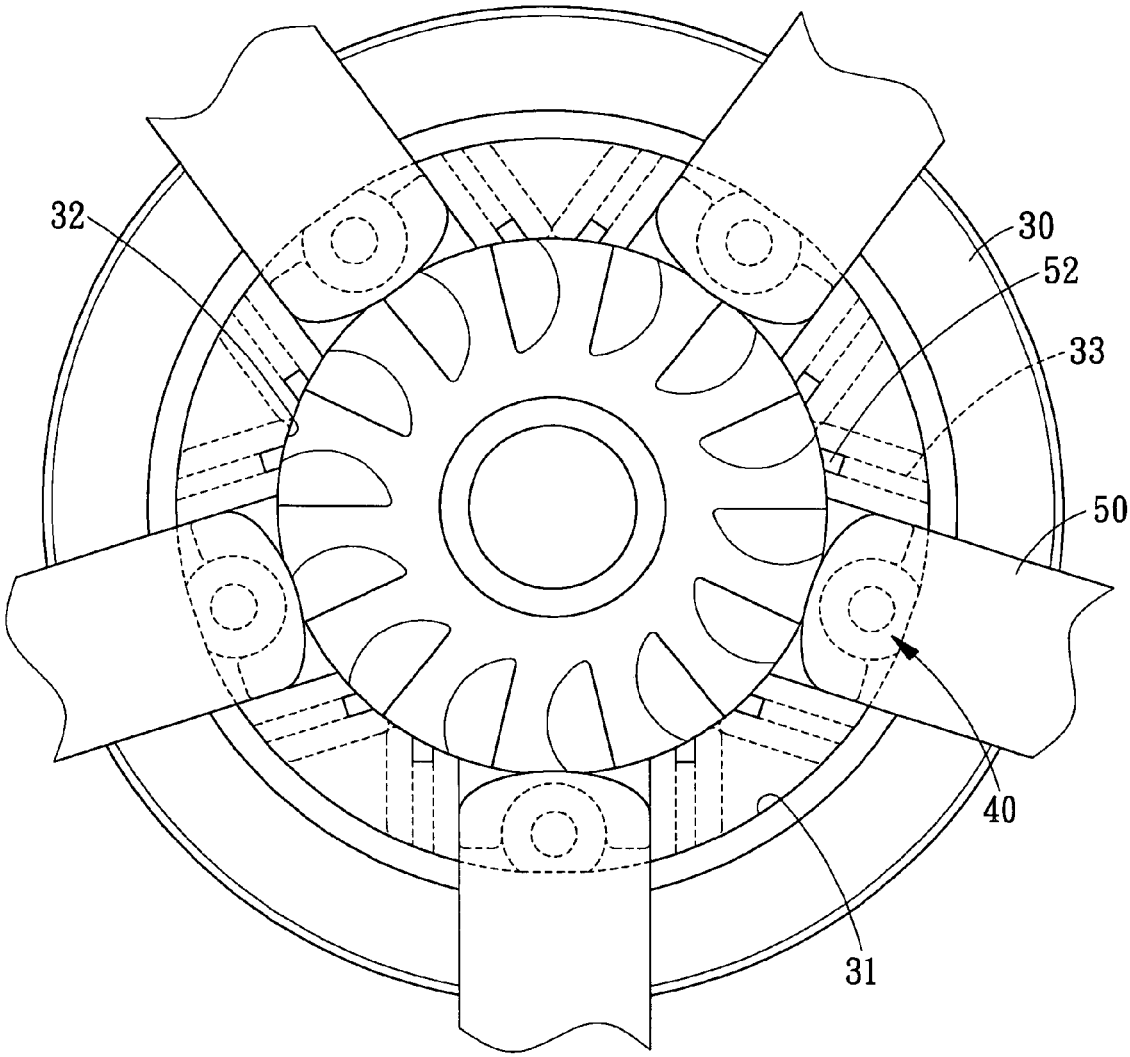
FIG. 3 is an assembly top view of blade bracket for a ceiling suspended fan in accordance with the first preferred embodiment of the present invention.
Figure 4:
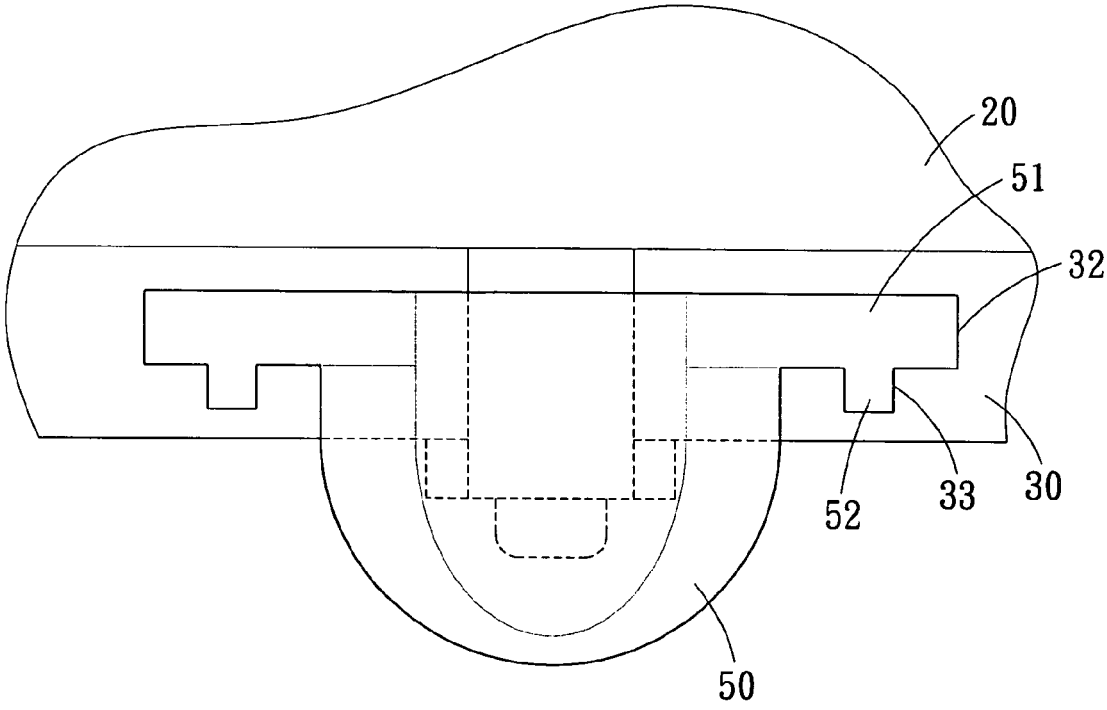
FIG. 4 is an illustrative view of a part of the blade bracket for a ceiling suspended fan in accordance with the first preferred embodiment of the present invention.
Figure 6:
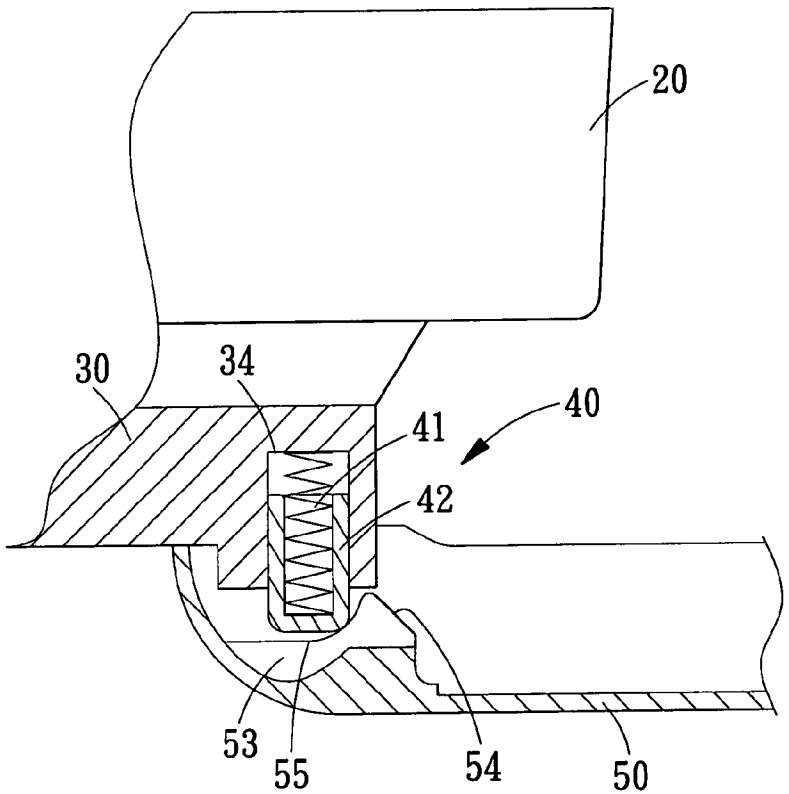
FIG. 6 is a cross sectional view of showing a compressible positioning structure in the blade bracket for a ceiling suspended fan in accordance with the first preferred embodiment of the present invention, after the compressible positioning structure is positioned.
Figure 5:
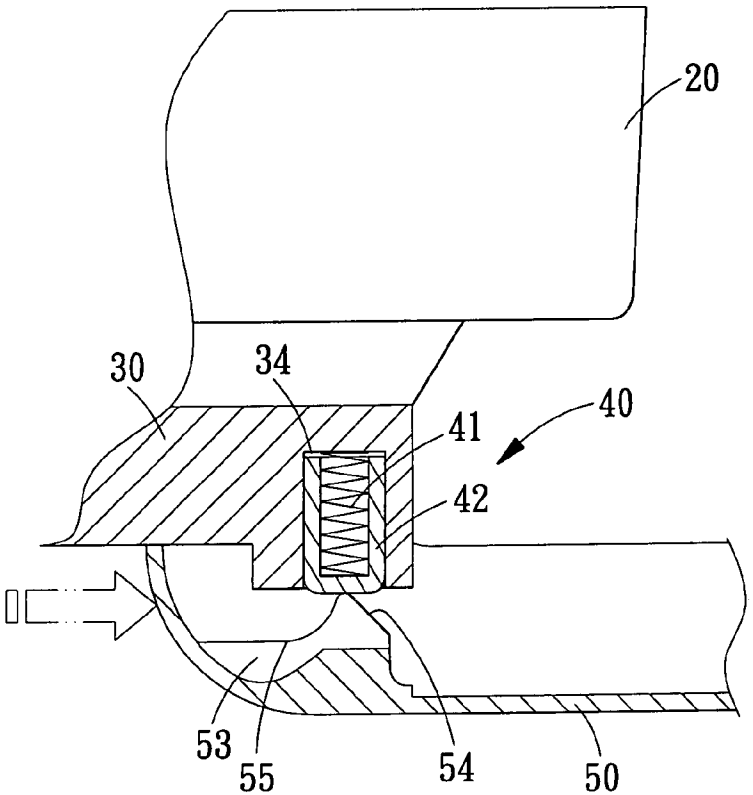
FIG. 5 is a cross sectional view of showing a compressible positioning structure in the blade bracket for a ceiling suspended fan in accordance with the first preferred embodiment of the present invention, before the compressible positioning structure is positioned.

Referring to FIGS. 2 and 3, an easy install blade bracket for a ceiling suspended fan in accordance with a first preferred embodiment of the present invention is shown and comprises: a rotary assembly 20, a discal seat 30, five positioning structures 40 and five fan blade mounting brackets 50.

The rotary assembly 20 is a known structure in a ceiling suspended fan, so no further explanations would be necessary.

The discal seat 30 is integrally formed and is attached to the bottom of the rotary assembly 20 by five screws, it formed along the discal seat 30 is a recess 31, on the sidewall of the recess 31 are defined five locking cavities 32, and at the bottom of the respective locking cavities 32 are arranged two guiding grooves 33. Around the outer margin of the recess 31 are provided five receiving cavities 34 correspondingly to the respective locking cavities 32.

The positioning structures 40, each of which is consisted of an elastic spring 41 and a cylindrical positioning member 42, are received in the respective receiving cavities 34. The elastic spring 41 is confined in the receiving cavity 34 by the positioning member 42 and biased between a bottom of the receiving cavity 34 and that of the positioning member 42, so as to permit an arc-shaped end of the positioning member 42 to protrude partially out of the receiving cavity 34 of the discal seat 30.

Each of the fan blade mounting brackets 50 is U-shaped in cross section, at either side of an abutting end of the fan blade mounting bracket 50 is formed a locking portion 51 correspondingly to the locking cavities 32 of the discal seat 30. The locking portion 51 is provided with a rib 52 correspondingly to the respective guiding grooves 33 of the discal seat 30. The locking portions 51 and the ribs 52 of the respective fan blade mounting brackets 50 are correspondingly positioned in the locking cavities 32 and the guiding grooves 33 of the discal seat 30. On the concave surface of the abutting end of the respective fan blade mounting brackets 50 are disposed two projections 53, each of the projections 53 includes a curved limit surface 55 and a guiding slope 54 arranged in the direction of the rotary assembly 20. The guiding slope 54 serves to compress the elastic spring 41 by pushing the positioning member 42, consequently, the positioning member 42 will be positioned on the curved limit surface 55.

For better understanding the present invention, its operations and functions, reference should be made to FIGS. 2, 4, 5 and 6. When assembling the fan blade mounting brackets 50, the locking portions 51 and the ribs 52 can be quick positioned in the locking cavities 32 and the guiding grooves 33 of the discal seat 30.

Meanwhile, the projections 53 of the fan blade mounting brackets 50 will use the guiding slope 54 to push the positioning member 42, accordingly the elastic member 41 is compressed to store energy. When the positioning member 42 is not pushed by the guiding slope 54 of the projections 53 anymore, the positioning member 42 will be returned to its original position and positioned on the curved limit surface 55 of the projection 53 of the fan blade mounting bracket 50, under the effect of the elastic member 41. At this moment, the positioning member 42 is confined by the curved limit surface 55, thus providing a quick and easy connection for the fan blade mounting bracket 50 and the discal seat 30.

Figure 7:
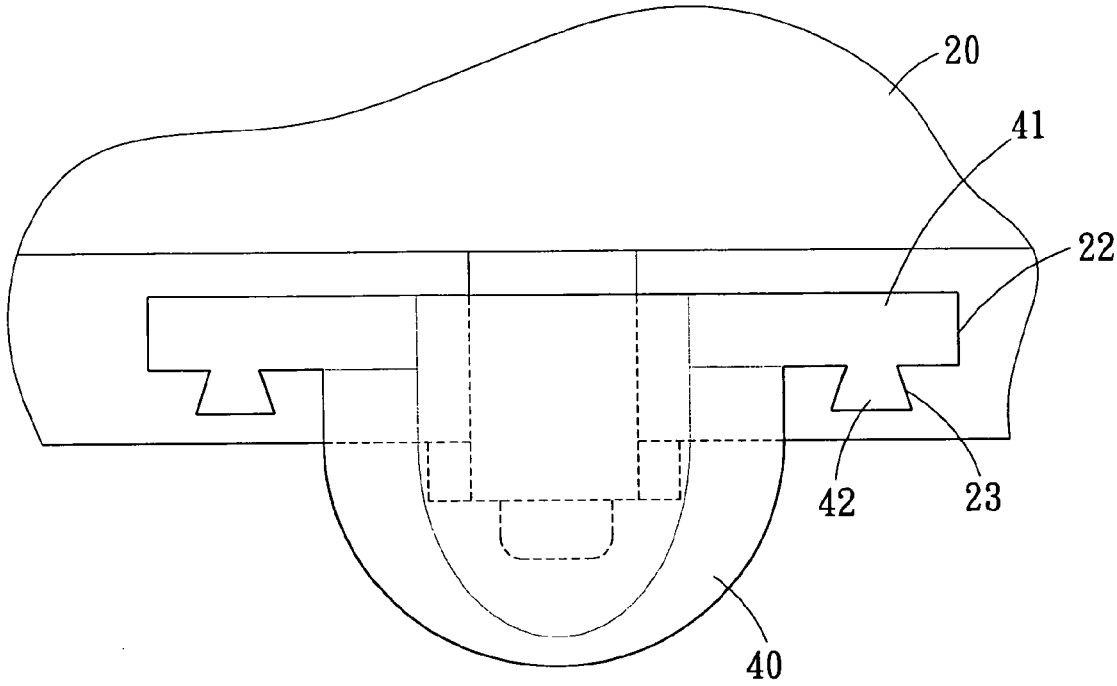
FIG. 7 is an illustrative view of showing a positioning structure of a blade bracket for a ceiling suspended fan in accordance with a second preferred embodiment of the present invention.

Referring to FIG. 7, which shows an easy install fan blade mounting bracket for a ceiling suspended fan in accordance with a second preferred embodiment of the present invention, and differences are described as follows:

The two guiding grooves 33 at the bottom of the locking cavities 32 of the discal seat 30 is dovetail-shaped in cross section, and the ribs 52 of the respective fan blade mounting brackets 50 are also dovetail-shaped in cross section, thus creating a more stable engagement between the fan blade mounting brackets 50 and the discal seat 30.

Figure 8:
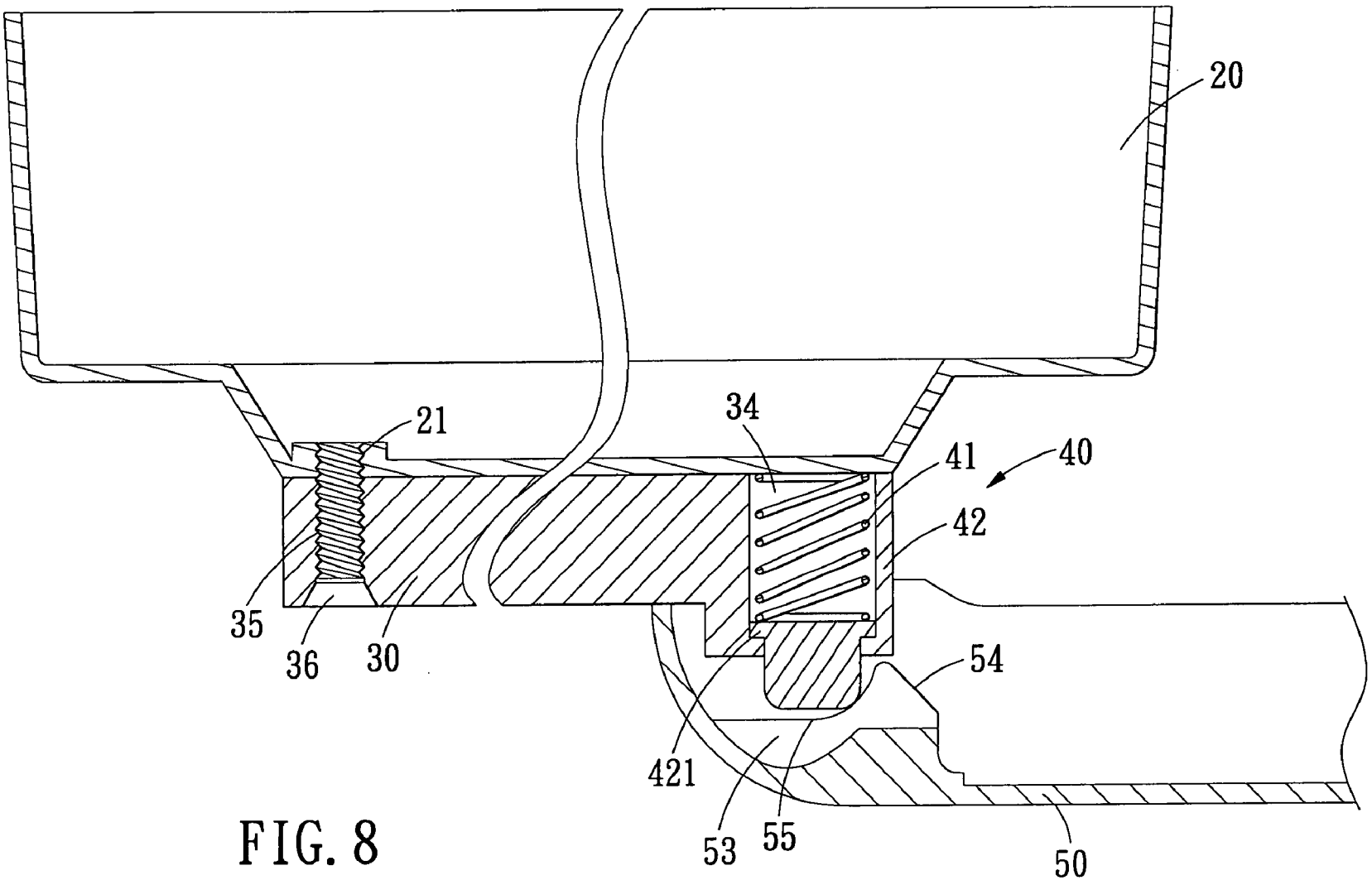
FIG. 8 is an assembly cross sectional view of showing a blade bracket for a ceiling suspended fan in accordance with a third preferred embodiment of the present invention.

The discal seat 30 in the first embodiment is integrally formed on the bottom of the rotary assembly 20, to make the present invention applicable to all types ceiling suspended fan, however, the discal seat 30 and the rotary assembly 20 are independent from each other, with reference to FIG. 8, in which a fan blade mounting bracket for a ceiling suspended fan in accordance with a third preferred embodiment of the present invention is shown.

At the bottom of the rotary assembly 20 are defined a plurality of connecting holes 21, and the discal seat 30 is correspondingly provided with a plurality of through holes 35, so that the discal seat 30 is fixed to the rotary assembly 20 by using screws 36 screwed in the through holes 35 of the discal seat 30 and the connecting holes 21 of the rotary assembly 20.

In addition, the discal seat 30 is provided with a plurality of step-shaped receiving cavities 34, and the respective positioning members 42 are provided with a flange 421. The positioning members 42 are received in the receiving cavities 34, and the flange 421 is confined therein by the step edge of the step-shaped receiving cavities 34. The elastic members 41 are also received in the step-shaped receiving cavities 34 and biased between the top surface of the positioning members 42 and the bottom surface of the rotary assembly 20. Therefore, the respective positioning members 42 will move in the receiving cavities 34 along the axial direction thereof, when it is subjected to an external force.

While we have shown and described various embodiments in accordance with the present invention, it should be clear to those skilled in the art that further embodiments may be made without departing from the scope of the present invention.

What is claimed is:

1. An install blade bracket for a ceiling suspended fan comprising:

a rotary assembly of a ceiling suspended fan;

a discal seat disposed at a bottom of the rotary assembly, at a bottom of the discal seat formed a recess, on sidewall of the recess defined a plurality of locking cavities, at outer margin of the recess provided a plurality of receiving cavities correspondingly to the respectively locking cavities;

a plurality of positioning structures being elastically and moveably disposed in the respective receiving cavities of the discal seat;

a plurality of fan blade mounting brackets, at an end of each of the fan blade mounting brackets formed a locking portion for being positioned in the locking cavities of the discal seat, a plurality of projections disposed on the respective; fan blade mounting brackets correspondingly to the positioning structures, each of the projections having a curved limit surface and a guiding slope arranged in the direction of the rotary assembly, such that after the guiding slope push the positioning structures, the positioning structures is positioned on the curved limit surface of the respective projections.

2. The install blade bracket for a ceiling suspended fan as claimed in claim 1, wherein the discal seat is integral formed on the bottom of the rotary assembly.

3. The install blade bracket for a ceiling suspended fan as claimed in claim 1, wherein the discal seat is detachably fixed to the bottom of the rotary assembly.

4. The install blade bracket for a ceiling suspended fan as claimed in claim 2, wherein a plurality of guiding grooves are formed at the bottom of the respective locking cavities, and correspondingly on the locking portions of the respective fan blade mounting brackets are formed a plurality of ribs which are to be positioned in the respective guiding grooves.

5. The install blade bracket for a ceiling suspended fan as claimed in claim 3, wherein a plurality of guiding grooves are formed at the bottom of the respective locking cavities, and correspondingly on the locking portions of the respective fan blade mounting brackets are formed a plurality of ribs which are to be positioned in the respective guiding grooves.

6. The install blade bracket for a ceiling suspended fan as claimed in claim 4, wherein the respective guiding grooves on the discal seat are dovetail-shaped in cross section, and the ribs of the respective fan blade mounting brackets also are dovetail-shaped in cross section, thus creating a stable engagement between the fan blade mounting brackets and the discal seat.

7. The install blade bracket for a ceiling suspended fan as claimed in claim 5, wherein the respective guiding grooves on the discal seat are dovetail-shaped in cross section, and the ribs of the respective fan blade mounting brackets also are dovetail-shaped in cross section, thus creating a stable engagement between the fan blade mounting brackets and the discal seat.

8. The install blade bracket for a ceiling suspended fan as claimed in claim 4, wherein each of the positioning structures comprises an elastic member and a cylindrical positioning member, the elastic spring is confined in the receiving cavity by the positioning member and biased between a bottom of the receiving cavity and that of the positioning member, so that the positioning member is positioned on the curved limit surface of the projection of the respective fan blade mounting brackets, under the effect of the elastic member.

9. The install blade bracket for a ceiling suspended fan as claimed in claim 5, wherein each of the positioning structures comprises an elastic member and a cylindrical positioning member, the elastic spring is confined in the receiving cavity by the positioning member and biased between a bottom of the receiving cavity and that of the positioning member, so that the positioning member is positioned on the curved limit surface of the projection of the respective fan blade mounting brackets, under the effect of the elastic member.

* * * * *